US005116024A

United States Patent [19]

Harvey

[11] Patent Number: 5,116,024

[45] Date of Patent: May 26, 1992

[54] SPACER SYSTEM

[75] Inventor: Bruce F. Harvey, Newark, Del.

[73] Assignee: Airsled Inc., Newark, Del.

[21] Appl. No.: 673,632

[22] Filed: Mar. 22, 1991

[51] Int. Cl.[5] ..... B66F 3/24

[52] U.S. Cl. ..... 254/93 HP; 254/134

[58] Field of Search ..... 254/93 HP, 134, 133, 254/88; 220/532, 533, 552; 229/120.36; 446/106, 124; 206/521.1; 493/913

[56] References Cited

U.S. PATENT DOCUMENTS

| | | | |
|---|---|---|---|
| 1,574,191 | 2/1926 | Groves | 446/106 |
| 1,630,140 | 5/1927 | Sibbald | 220/552 |
| 2,609,177 | 9/1952 | Hughes | 254/93 HP |
| 2,804,118 | 8/1957 | Bayerkohler | 254/93 HP |
| 2,844,910 | 7/1958 | Korchak | 446/106 |
| 3,870,277 | 3/1975 | West | 254/88 |
| 4,932,548 | 6/1990 | Bensinger | 220/552 |
| 5,033,146 | 7/1991 | Fogarty et al. | 254/88 |

FOREIGN PATENT DOCUMENTS

| | | | |
|---|---|---|---|
| 2301981 | 7/1974 | Fed. Rep. of Germany | 446/106 |
| 116579 | 10/1969 | United Kingdom | 220/552 |

*Primary Examiner*—Robert C. Watson

*Attorney, Agent, or Firm*—Connolly and Hutz

[57] ABSTRACT

A spacer system of variable height comprises two longitudinal upper members and three transverse lower members. Each of the longitudinal and transverse members includes plural groupings of adjacent slots of varying depth. The upper longitudinal members each have three spaced apart groupings of adjacent slots with two slots of varying depth in each grouping while the transverse lower members each have two groupings of adjacent slots with three slots of varying depth in each grouping. The slots in the upper longitudinal members open in a downward direction and interlockingly and releasably engage the slots in the lower transverse members which open in an upward direction. Variable height of the spacer system depends upon which slot of each grouping in the longitudinal members interlocks and releasably engages a given slot of each grouping in the transverse members.

8 Claims, 3 Drawing Sheets

SPACER SYSTEM

BACKGROUND OF THE INVENTION

The present invention relates to a spacer system, and more particularly to an adjustable spacer system for placement between an inflatable air beam and the elevated frame of a high leg vending machine.

Prior to the present invention numerous arrangements have been proposed for moving heavy vending machines and other appliances, such as refrigerators and the like. One of these arrangements basically comprises a relatively thin inflatable air beam having a flexible perforated bottom sheet sealed to the edges of a rigid backing plate. When the air beam is inflated by a blower attached to the beam by a hose, a constant flow of air is forced through the many small holes in the perforated bottom sheet. In use, when the beam is placed under a load, such as a vending machine, for example, and the blower is energized, a pressure of about one pound per square inch is created and the vending machine rises. The overall arrangement significantly reduces labor cost and the back injuries often associated with manual lifting. Air beams are relatively inexpensive and provide a unique arrangement for moving heavy objects into and out of tight places.

Most air beams are relatively flat and these constructions are not suitable for lifting high leg vending machines and similar appliances that include a significantly elevated frame. Spacing structure or fillers are then required for placement between the air beam and the elevated frame. Moreover, since the height of these elevated frames varies from one machine or appliance to the next, spacers or fillers of different height are required.

SUMMARY OF THE INVENTION

Accordingly, it is an object of the present invention to provide an adjustable spacer system for placement between an air beam and the elevated frame of an appliance o load to be lifted.

Another object of the present invention is an adjustable spacer system which is simple in design and easy to use and which has a variety of heights to accommodate appliances or loads having different frame heights.

Still another object of the present invention is an adjustable spacer system constructed and arranged for placement between an inflatable air beam and the elevated frame of a high leg vending machine.

In accordance with the present invention, a spacer system of variable height comprises at least one longitudinal spacer member and a plurality of separate transverse spacer members. Each of the longitudinal and transverse spacer members has plural groupings of adjacent slots, and each grouping includes slots of varying depth. Each of the slots in the longitudinal spacer member has an open end and all of the open ends face in one direction. Each of the slots in the transverse spacer members also has an open end and all of the open ends face in a direction opposite the slots in the longitudinal spacer member. The slots in both members are constructed and arranged to interlockingly and releasably engage one another, and the spacer members are assembled through such interlocking and releasable engagement. Variable height of the spacer system is obtained depending upon which slot of each grouping in the longitudinal spacer member interlockingly and releasably engages a given slot of each group in the transverse spacer members.

Preferably, the spacer system of the present invention includes two upper longitudinal spacer members and three lower transverse spacer members. Moreover, each grouping of adjacent slots in the longitudinal spacer members preferably includes two slots of different depth, and each grouping of adjacent slots in the transverse spacer members preferably includes three slots of different depth.

The longitudinal and transverse spacer members are generally planar and in their in use positions they are vertically oriented. Additionally, the slots in the upper longitudinal spacer members open in a downward direction while the slots in the lower transverse spacer members open in an upward direction.

The spacer system of the present invention is preferably utilized in combination with a generally flat horizontally oriented inflatable air beam with the spacer system resting upon the air beam directly below the frame of the machine or load to be lifted by the beam.

BRIEF DESCRIPTION OF THE DRAWINGS

Novel features and advantages of the present invention in addition to those described above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
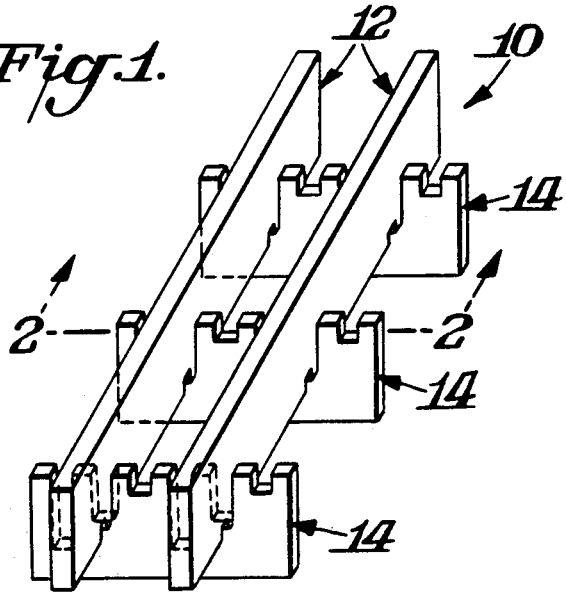
FIG. 1 is a pictorial view of a spacer system, according to the present invention.
Figure 2:
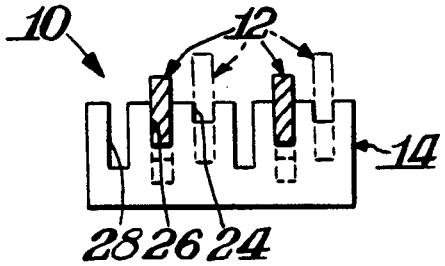
FIG. 2 is a cross-sectional view taken along line 2—2 of FIG. 1 and also showing in phantom outline another height of the spacer system.

Referring in more particularity to the drawings, FIGS. 1 and 2 illustrate a spacer system 10 of variable height. This system comprises two upper longitudinal spacer members 12 and three lower transverse spacer members 14. As explained more fully below, the longitudinal and transverse spacer members cooperate with one another to provide a spacer construction of variable height.

Figure 3:
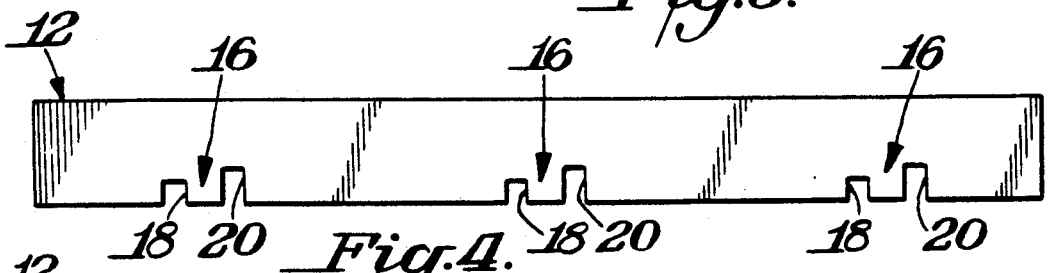
FIG. 3 is a side elevational view of one of the two upper longitudinal members of the spacer system shown in FIG. 1.
Figure 4:
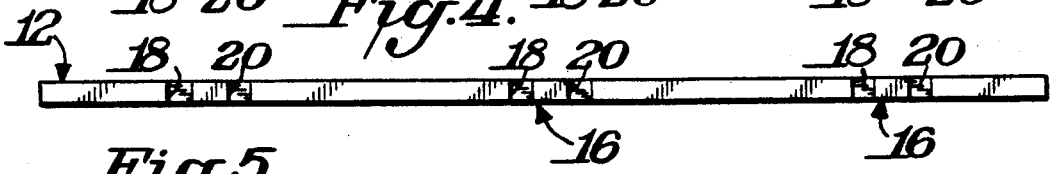
FIG. 4 is a bottom plan view of the longitudinal member shown in FIG. 3.

FIGS. 3 and 4 illustrate the details of each of the longitudinal spacer members 12. Specifically, each longitudinal spacer member has three groupings 16 of adjacent slots 18, 20, and and these slots have varying depths and face in a downward direction. Preferably, the longitudinal spacer members are generally planar and vertically oriented when assembled, as shown best in FIG. 1.

Figure 5:
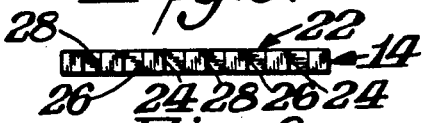
FIG. 5 is a top plan view of one of the three lower transverse members of the spacer system shown in FIG. 1.
Figure 6:
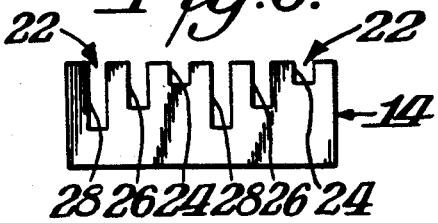
FIG. 6 is a side elevational view of the transverse member shown in FIG. 5.

FIGS. 5 and 6 illustrate the details of each of the transverse spacer members 14. Specifically, each transverse spacer member has two groupings 22 of adjacent slots 24, 26, 28, and these slots have varying depths and face in a downward direction. Preferably, the transverse spacer members are generally planar and vertically oriented when assembled, as shown best in FIG. 1.

The slots in the longitudinal and transverse spacer members are constructed and arranged to interlockingly and releasably engage one another in the formation of the spacer system 10. Any one of the two downwardly facing slots 18, 20 in the longitudinal spacer member 12 may interlockingly and releasably engage any one of the three upwardly facing slots 24, 26, 28 in the transverse spacer member 14. Since slots 18 and 20 vary in depth and slots 24, 26, 28 also vary in depth, the spacer system 10 illustrated in the drawings has six overall height adjustments. Specifically, slot 18 may interlockingly and releasably engage any one of slots 24, 26 or 28 thereby providing three overall height adjustments. Similarly, slot 20 may interlockingly and releasably engage any one of slots 24, 26 or 28 for three more height adjustments of the spacer system.

Figure 7A:
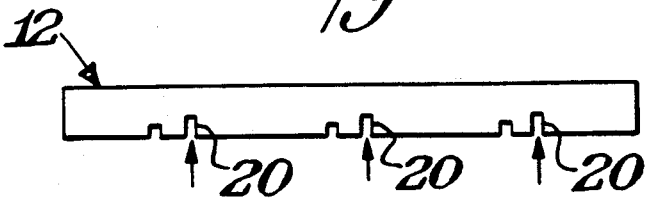
FIGS. 7A and 7B are side elevational views of the upper longitudinal and lower transverse members illustrating the lowest setting of the spacer system.
Figure 7B:
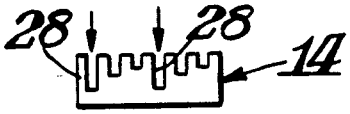

FIGS. 7A and 7B through FIGS. 12A and 12B illustrate each of the six variable heights of spacer system 10. FIGS. 7A and 7B show the lowest setting of the spacer system where the downwardly facing slots 20 in the upper longitudinal spacer members 12 interlockingly and releasably engage the upwardly facing slots 28 in the transverse spacer members 14.

Figure 8A:
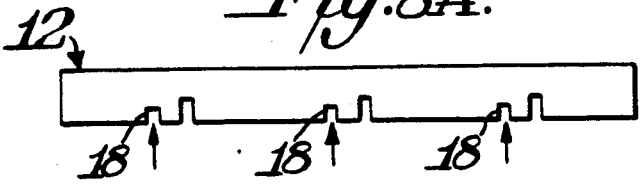
FIGS. 8A and 8B are side elevational views of the upper longitudinal and lower transverse members illustrating a low setting of the spacer system.
Figure 8B:
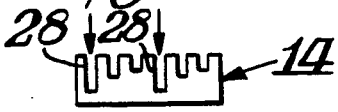

FIGS. 8A and 8B illustrate a low setting of the spacer system 10. In this setting the downwardly facing slots 18 in the upper longitudinal spacer members 12 interlockingly and releasably engage the upwardly facing slots 28 in the transverse spacer members 14.

Figure 9A:
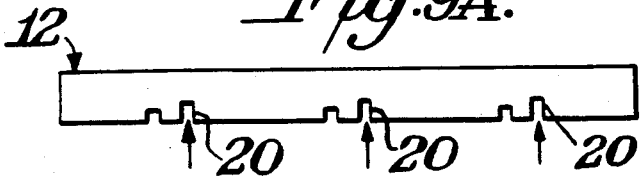
FIGS. 9A and 9B are side elevational views of the upper longitudinal and lower transverse members illustrating a medium-low setting of the spacer system.
Figure 9B:
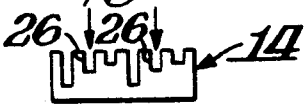

FIGS. 9A and 9B illustrate a medium-low setting of the spacer 10. In this setting the downwardly facing slots 20 in the upper longitudinal spacer members 12 interlockingly and releasably engage the upwardly facing slots 26 in the transverse spacer members 14.

Figure 10A:
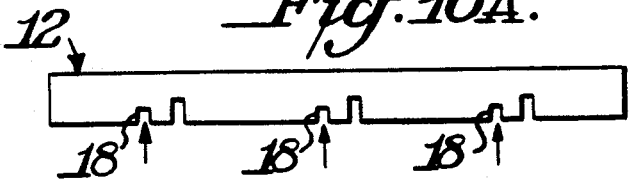
FIGS. 10A and 10B are side elevational views of the upper longitudinal and lower transverse members illustrating a medium-high setting of the spacer system.
Figure 10B:
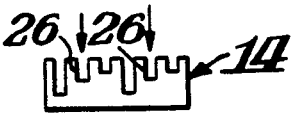

FIGS. 10A and 10B illustrate a medium-high setting of the spacer system 10. In this setting the downwardly facing slots 18 in the upper longitudinal spacer members 12 interlockingly and releasably engage the upwardly facing slots 26 in the transverse spacer members 14.

Figure 11A:
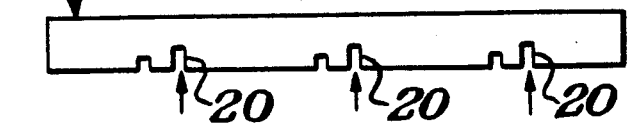
FIGS. 11A and 11B are side elevational views of the upper longitudinal and lower transverse members illustrating a high setting of the spacer system.
Figure 11B:
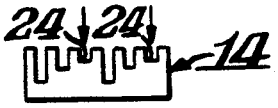

FIGS. 11A and 11B illustrate a high setting of the spacer system 10. In this setting the downwardly facing slots 20 in the upper longitudinal spacer members 12 interlockingly and releasably engage the upwardly facing slots 24 in the transverse spacer members 14.

Figure 12A:
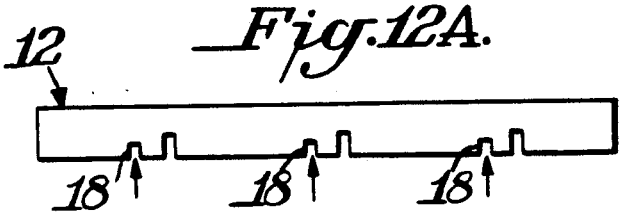
FIGS. 12A and 12B are side elevational views of the lower longitudinal and lower transverse members illustrating the highest setting of the spacer system.
Figure 12B:
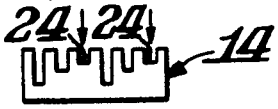

FIGS. 12A and 12B illustrate the highest setting of the spacer system 10. In this setting the downwardly facing slots 18 in the upper longitudinal spacer members 12 interlockingly and releasably engage the upwardly facing slots 24 in the tranverse spacer members 14.

Figure 13:
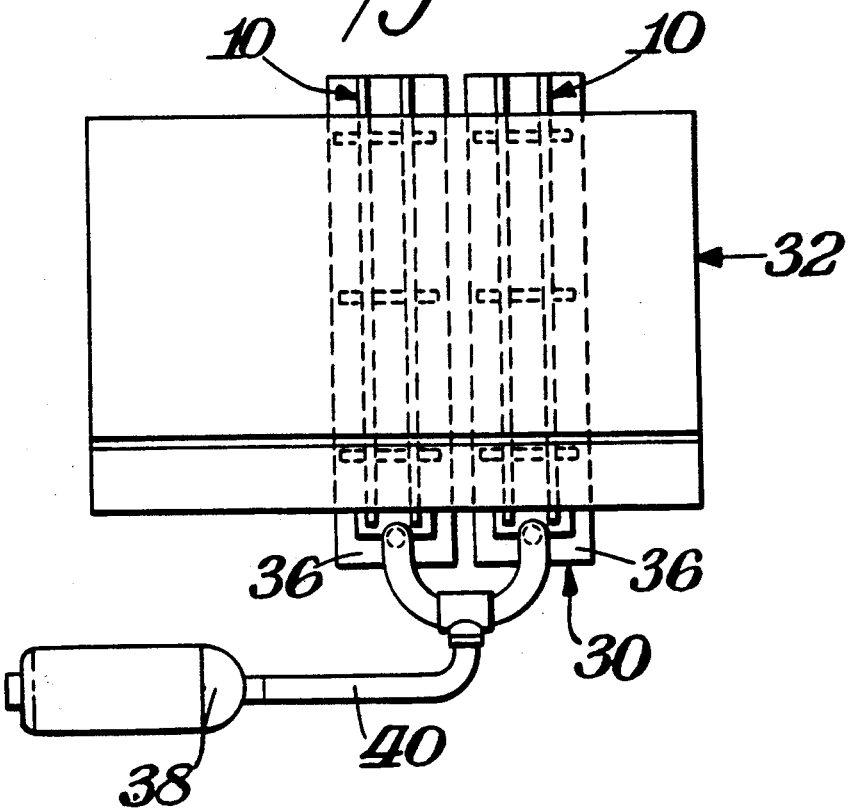
FIG. 13 is a top plan view of a pair of inflatable air beams with a spacer system positioned between each beam and an elevated vending machine frame.
Figure 14:
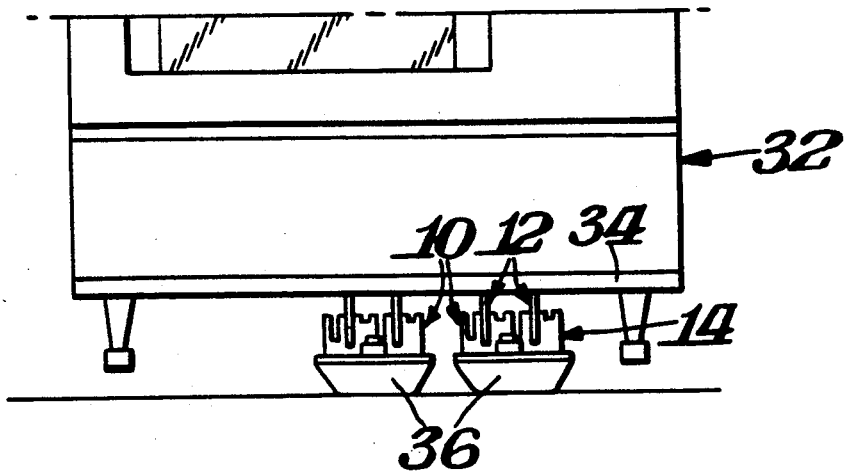
FIG. 14 is a front elevational view of a pair of inflatable air beams with a spacer system positioned between each beam and an elevated vending machine frame.

FIGS. 13 and 14 show an appliance mover 30 for moving heavy vending machines and other appliances, such as refrigerators and the like. A high leg vending machine 32 is also shown and this machine has an elevated frame 34. The appliance mover includes a pair of relatively thin inflatable air beams 36 and each beam generally includes a flexible perforated bottom sheet sealed to the edges of a rigid backing plate. The air beams are inflated by a blower 38 attached to each beam by hoses 40. With high leg vending machines such as 2, the inflatable air beams are incapable of engaging the elevated frame 34. Hence, spacers or fillers are required for placement between the air beams and the elevated frame. Once the distance between the air beam and the elevated frame is determined, spacer system 10 is assembled in a manner that produces the required overall height. One such spacer system 10 is then positioned between each air beam and the frame 34, and upon inflation of blower 38 the vending machine 32 is lifted and easily transplanted. The middle transverse member not only supports the pair of longitudinal members but also prevents the air beam from excessive bulging.

The longitudinal and transverse spacer members may be of any desired length, such as 36 or 44 inches for the longitudinal members and 9 inches for the transverse members. Also, the overall height adjustment of the spacer system 10 may range between 4 and 7 inches. Moreover, it should be noted that the spacer system can be adjusted to a lower position at one end when the vending machine frame is lower in the front or back.

What is claimed is:

1. A spacer system of variable height comprising at least one longitudinal spacer member and a plurality of separate transverse spacer members, and a generally flat horizontally oriented inflatable air beam with the spacer system resting upon the air beam, each of the longitudinal and transverse spacer members having plural groupings of adjacent slots and each grouping including slots of varying depth, each of the slots in the longitudinal spacer member having an open end with all of the open ends facing on one direction and each of the slots in the transverse spacer members having an open end with all of the open ends facing in an opposite direction, the slots in the longitudinal and transverse spacer members being constructed and arranged to interlockingly and releasably engage one another whereby upon assembly of the longitudinal spacer member with the transverse spacer members through interlocking and releasable engagement between the open ended slots variable height of the spacer system is obtained depending upon which slot of each grouping in the longitudinal spacer member interlockingly and releasably engages a given slot of each grouping in the transverse spacer members.

2. A spacer system of variable height as in claim 1 including two longitudinal spacer members and three transverse spacer members.

3. A spacer system of variable height as in claim 1 wherein each grouping of adjacent slots includes at least two slots of different depth.

4. A spacer system of variable height as in claim 3 wherein each grouping of adjacent slots in the longitudinal spacer members includes two slots of different depth and each grouping of adjacent slots in the transverse spacer members includes three slots of different depth.

5. A spacer system of variable height as in claim 4 including two longitudinal spacer members and three transverse spacer members.

6. A spacer system of variable height as in claim 1 wherein the longitudinal and transverse spacer members are generally planar and vertically oriented, and wherein the slots in the longitudinal spacer members open in a downward direction while the slots in the transverse spacer members open in an upward direction.

7. A spacer system of variable height as in claim 1 including two upper longitudinal spacer members each having three spaced apart groupings of adjacent slots with two slots of varying depth in each grouping, and three transverse lower spacer members each having two groupings of adjacent slots with three slots of varying depth in each grouping.

8. A spacer system of variable height as in claim 7 wherein the longitudinal and transverse spacer members are generally planar and vertically oriented, and wherein the slots in the upper longitudinal spacer members open in a downward direction while the slots in the lower transverse spacer members open in an upward direction.

* * * * *